US006494009B1

(12) United States Patent
Kang

(10) Patent No.: US 6,494,009 B1
(45) Date of Patent: Dec. 17, 2002

(54) GREEN CONCRETE RETAINING WALL AND METHOD FOR CONSTRUCTING THE SAME

(76) Inventor: Soo-Yong Kang, New Town Apt. 13-1201, Bisan-3dong 341, Dongan-Ku, Anyang-si, Kyunggi-do 431-819 (KR)

( * ) Notice: Subject to any disclaimer, the term of this patent is extended or adjusted under 35 U.S.C. 154(b) by 0 days.

(21) Appl. No.: 09/943,270

(22) Filed: Aug. 30, 2001

(51) Int. Cl.[7] ..... E04C 3/30

(52) U.S. Cl. ..... 52/575; 256/19; 405/280; 405/285

(58) Field of Search ..... 52/575, 169.1, 52/162.2, 169.4, 170, 596; 256/19; 405/275, 205, 286, 287.1, 280, 284; 14/26

(56) References Cited

U.S. PATENT DOCUMENTS

| | | | | | |
|---|---|---|---|---|---|
| 3,195,312 | A | * | 7/1965 | Rumsey, Jr. | |
| 3,747,353 | A | * | 7/1973 | Monahan | 61/39 |
| 3,977,199 | A | * | 8/1976 | Chiaves | 61/39 |
| 4,659,261 | A | * | 4/1987 | Chiaves | 405/286 |
| 5,125,765 | A | * | 6/1992 | Verble | 405/31 |
| 5,468,098 | A | * | 11/1995 | Babcock | 405/262 |
| 5,531,547 | A | * | 7/1996 | Shimada | 405/262 |
| 5,549,418 | A | * | 8/1996 | Devine et al. | 405/258 |
| 5,669,737 | A | * | 9/1997 | Equilbec et al. | 405/262 |
| 5,707,183 | A | * | 1/1998 | Akamine | 405/284 |
| 6,341,922 | B1 | * | 1/2002 | Jaecklin | 405/280 |

FOREIGN PATENT DOCUMENTS

| | | |
|---|---|---|
| KR | 238494 | 10/1999 |

* cited by examiner

*Primary Examiner*—Yvonne M. Horton
(74) *Attorney, Agent, or Firm*—Abelman, Frayne & Schwab

(57) ABSTRACT

A concrete retaining wall is disclosed on which flora can be cultured and a method for constructing the same. The retaining wall has a steel skeleton constructed with basal H-beams, aerial H-beams, L-beams, structural steel tubes and steel plates. The basal H-beams and the aerial beams are arranged in a direction parallel with the earth's surface and at a significant angle to the earth's surface, respectively, at such space intervals and dimensions that the retaining wall structure has sufficient bending resistance to overcome active earth pressures. The L-beams, the structural steel tubes and the steel plates are provided as reinforcements between the H-beams. Watertight concrete is applied to the basal H-beams. Wire mesh is attached to the aerial H-beams, the L-beams, the structural tubes and steel plates. The wire-mesh-mounted structure is coated with water-permeable concrete to form a stepped or embossed external surface. The water-permeable concrete is covered with artificial greening soil, which allows the growth of flora therein.

16 Claims, 2 Drawing Sheets

FIG. 1a
PRIOR ART
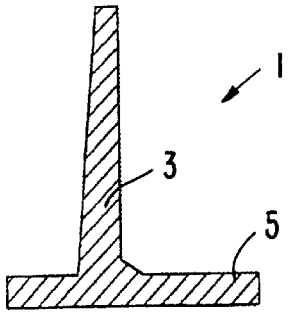
VERTICLE TYPE
FIG. 1b
PRIOR ART
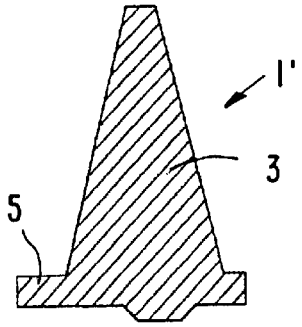
TRAPEZOIDAL TYPE
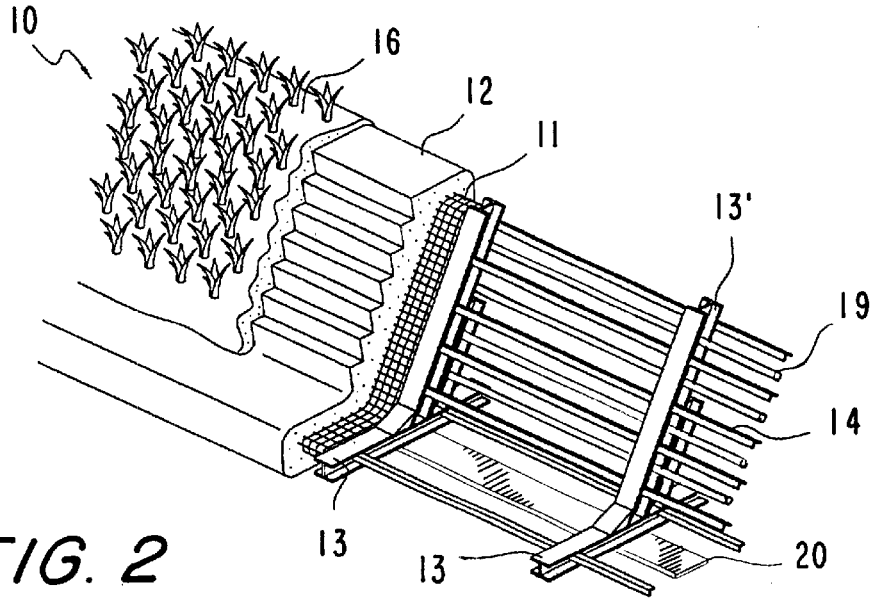
FIG. 2

GREEN CONCRETE RETAINING WALL AND METHOD FOR CONSTRUCTING THE SAME

BACKGROUND OF THE INVENTION

1. Field of the Invention

The present invention relates to a concrete retaining wall and a method for constructing the same. More particularly, the present invention relates to a green concrete retaining wall in which flora, such as plants, grasses, flowers and the like, can be cultured, and a method for constructing the same. The term "green concrete retaining wall" used herein means the concrete retaining wall in which various kinds of plants can be implanted, seeded, cultured and/or grown.

2. Description of the Prior Art

On the whole, when a steep slope is artificially built up by cutting or banking a naturally sloping land, a concrete structure is used. There are known to the prior art vertical and trapezoidal (FIG. 1*b*), watertight, concrete retaining wall structures for use in the construction of a steep slope.

Most of the studies that have been done for concrete retaining walls relate to use of concrete forms in constructing reinforced concrete retaining walls from steel and watertight concrete and to prefabrication of blocks which can be formed into concrete retaining walls simply by assemblage without using concrete forms.

For instance, Korean Pat. No. 238494 discloses a retaining wall construction method using concrete blocks, in which reinforcing bars are arranged crossways to provide structural stability, thereby constructing concrete retaining walls at heights from less than 2.0 m to 10.0 m without using concrete forms. According to this method, the arrangement structure and quantity of reinforcing bars can be suitably selected depending on construction situations, including the height of the retaining wall and the soil pressure, so that there can be brought about an economic benefit. In addition, this method enjoys the advantage of freely constructing curved sides.

Also, there are disclosed prefabricated concrete retaining walls (Korean Pat. Publication No. 74-987), concrete blocks for use in retaining walls (Korean Pat. No. 16123), and flexible joints for concrete retaining walls (Korean Pat. No. 128,126).

In an aspect of mechanical (structural) analysis, typically, concrete retaining walls are constructed with watertight reinforced concrete for resisting the overturning and the sliding failure and securing desired the bearing capacity force, and with steel bars for accomplishing desired mechanical and structural resistance to bending stress, shearing stress, or etc. Also, the overturning, the sliding failure, and the bearing capacity failure are the subjects of which account is taken in designing the appearance and dimension of concrete retaining walls.

However, most of conventional concrete retaining wall structures stand, taking straight shapes, such as vertical planes, with boring gray colors, and defiling the appearance of the street. Also, conventional concrete retaining wall structures require a long period of time for their construction. Because of taking vertical planes, conventional concrete retaining walls are under a high active earth pressure and are provided with long low plates (the base slab) to withstand the high active earth pressure. Further, to cope with the high active earth pressure, not only does the concrete retaining wall have a large cross section which is responsible for resistance to bending, but the earth work is required to have the soil at the back side of the wall cut in a large amount. With such structures, conventional retaining walls are likely to suffer the sliding failure and the overturning when water is not properly drained. Accordingly, in consideration of bending resistance and shear resistance against active earth pressure, reinforcing bars must be arranged in the watertight concrete of the retaining walls. However, design drawings for showing the arrangement of reinforcing bars are complicated and difficult to make. Additionally, when following the instruction of the design drawings, undesirable structures may be constructed as a result of miswriting, misreading or other supervisory mistakes. During the application of concrete to the work site, material segregation takes place, giving difficulty to the quality control. Difficulty is also found in the application of reinforcing bars to concrete retaining walls. Further, conventional concrete retaining walls suffer from the disadvantage in that it is difficult to accurately predict what will happen if concrete forms are deformed during the application of concrete. Joints, which are sometimes formed to link parts of conventional concrete retaining walls to each other therethrough, have negative influence on the appearance of the concrete retaining walls. During the curing of the concrete applied for the construction of retaining walls, cracks may be formed, deteriorating the endurance of the retaining walls constructed. Moreover, conventional concrete retaining walls are likely to suffer structural deformation as well as cracking, and there are no methods for perfectly compensating for either of them. Conventional concrete retaining walls are limited to 9.0 m in construction height.

Therefore, there remains a need for a concrete retaining wall structure which is structurally safe and can be constructed within a short period of time and in which flora, such as plants, lawns, flowers, etc., can be implanted and grown.

SUMMARY OF THE INVENTION

Leading to the present invention, the intensive research on concrete retaining walls, conducted by the present inventors, resulted in the finding that a steel skeleton in which aerial H beams stand at a certain angle to basal H beams can resist the overturning and the sliding failure and secure desired the bearing capacity force and, that artificial greening soil, if applied to retaining wall, allows plants to be cultured, contributing to the attractive appearance of the street.

Therefore, it is an object of the present invention to provide a concrete retaining wall which is structurally solid and can be constructed within a short period of time.

It is another object of the present invention to provide a concrete retaining wall in which plants, grasses, flowers and the like can be implanted and grown.

It is a further object of the present invention to provide a method for constructing such a concrete retaining wall.

In an aspect of the present invention, there is provided a method for constructing a concrete retaining wall structure, comprising the steps of: establishing a steel skeleton comprising basal H beams, aerial H beams, L beams, structural steel tubes and steel plates, said basal H beams and said aerial beams being arranged in a direction parallel with the earth surface and at a significant angle to the earth surface, respectively, at such space intervals and dimensions that the retaining wall structure has sufficient bending resistance to overcome the active earth pressures, said L beams, said structural steel tubes and said steel plates being provided as reinforcements between said arranged H beams; applying watertight concrete to the H beams formed as bases of the steel skeleton in the horizontal direction to support the steel skeleton; providing wire meshes onto the vertically directing H beams, the L beams, the structural tubes and steel plates; coating the wire mesh-mounted structure with water-permeable concrete to form a stepped or embossed external surface; and covering the concrete with artificial greening soil, the artificial greening soil allowing the growth of flora therein.

BRIEF DESCRIPTION OF THE DRAWINGS

The above and other objects, features and other advantages of the present invention will be more clearly understood from the following detailed description taken in conjunction with the accompanying drawings, in which:

FIGS. 1*a* and 1*b* are cross sectional views showing conventional retaining walls of the prior art;

FIG. 2 is a partially broken perspective view showing a concrete retaining wall in accordance with one embodiment of the present invention;

PREFERRED EMBODIMENT OF THE INVENTION

Figure 3:
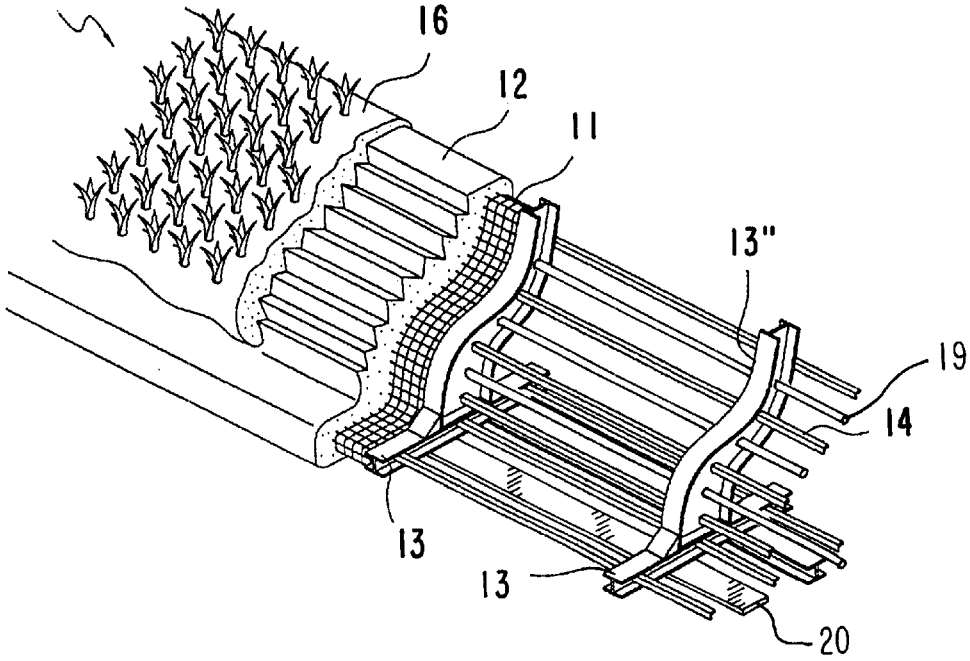
FIG. 3 is a partially broken perspective view showing a concrete retaining wall in accordance with another embodiment of the present invention.

The present invention pertains to a concrete retaining wall of the prior art which is nature-friendly and structurally solid. In the present invention, a structure constructed with H-beams, L-beams, wire meshes, and steel plates 20 is employed, to which water-permeable concrete is applied in such a way as to provide a stepped or rugged slant side which is coated with artificial greening soil to allow the implantation and growth of flora such as plants, herbs, flowers, and the like.

The application of the preferred embodiments of the present invention is best understood with reference to the accompanying drawings, wherein like reference numerals are used for like and corresponding parts, respectively.

By way of illustrating structures of the prior art, FIG. 1*a* schematically illustrates the typical construction of a vertical retaining wall structure and FIG. 1*b* a trapezoidal structure. Each structure 11 is comprised of a generally vertical member 3 that is formed integrally with a generally horizontal base 5. Referring to FIG. 2, there is shown a concrete retaining wall 10 in accordance with an embodiment of the present invention. As seen in this figure, the concrete retaining wall 10 of this embodiment of the present invention has a steel skeleton made of H beams 13 and 13', L beams 14, wire meshes 11, a concrete muscle 12, coated on the skeleton, having a stepped slant side, and a greening soil skin 16 covering the concrete 12. The concrete 12 suitable for use in the present invention is so water-permeable that water can be provided to grow flora in the retaining wall. In order to contain water therein, thus, the concrete 12 is required to be porous and light in weight. However, since porous concrete such as water-permeable concrete has half to one third the compression strength of ordinary watertight concrete, reinforcements to be used must have far greater bending moments than those of steel bars in order to meet the requirements for structural mechanical functions of the retaining walls. Suitable for use to this end are H beams 13 and 13', L beams 14, and steel plates 20. The steel structure bears the bending stress and shearing stress that the active earth pressure exerts.

Referring to FIG. 2, there is shown a concrete retaining wall 10 in accordance with an embodiment of the present invention. As seen in this figure, the concrete retaining wall 10 of this embodiment of the present invention has a steel skeleton made of H beams 13 and 13', L beams 14, wire meshes 11, a concrete muscle 12, coated on the skeleton, having a stepped slant side, and a greening soil skin 16 covering the concrete 12. The concrete 12 suitable for use in the present invention is so water-permeable that water can be provided to grow flora in the retaining wall. In order to contain water therein, thus, the concrete 12 is required to be porous and light in weight. However, since porous concrete such as water-permeable concrete has half to one third the compression strength of ordinary watertight concrete, reinforcements to be used must have far greater bending moments than those of steel bars in order to meet the requirements for structural mechanical functions of retaining walls. Suitable for use to this end are H beams 13 and 13', L beams 14, and steel plates 20. The steel structure bears the bending stress and shearing stress that the active earth pressure exerts.

In accordance with the present invention, the steel components constituting the steel skeleton, that is, H beams 13 and 13', L beams 14, and other steel tubes 19 and plates 20 have strengths large enough to and are arranged at such distance intervals as to resist the bending stress exerted by the active earth pressure. When the concrete retaining wall is established at a steep geographical site, the skeleton structure may be resistant to the overturning, but does not endure the force of the slope failure and slide failure (lateral displacement). In this case, the skeleton structure may be additionally reinforced with anchors or shear keys at its back face.

Figure 4:
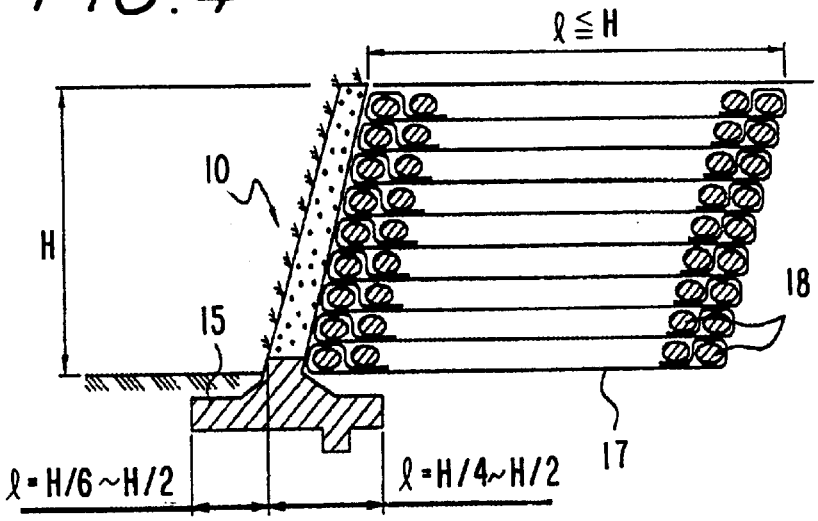
FIG. 4 is a schematic cross sectional view showing a concrete retaining wall in accordance with a further embodiment of the present invention.

The H beams 13 and 13'are determined in length and arrangement distance so as to meet the bending resistance requirements, and established in a direction parallel with the earth's surface and at an angle to the earth's surface, respectively. Between the arranged H beams, L beams 14 and other structural steel tubes 19 and plates 20 are installed for reinforcement. Functioning as a backbone responsible for the aerial part of the retaining wall, the H beams 13' are bound onto the H beams 13, which are arranged as base supports. On the basis of the connection point between the basal H beams and the aerial H beams, each basal H beam can be a front side part, which will be exposed to the exterior, and a back side part, which will be directed to banks or slopes. It is preferable in a view of safety that the length of the front side part is one sixth to half of the height of the retaining wall while the 3back side part ranges, in length, from one fourth to half of the height of the retaining wall, as seen in FIG. 4. To the H beams 13 functioning as basal supports, ordinary watertight concrete is applied. However, water-permeable concrete, in which the present invention is featured, is coated in a stepped form on the vertically arranged H beams which function as aerial supports.

In accordance with the present invention, wire meshes 11 are provided to the H and L beams 13, 13' and 14 in order to prevent the occurrence of cracks during the curing of concrete and improve the bonding strength between the concrete and the H and L beams, prior to the application of the concrete. Subsequently, the water-permeable concrete 12 is covered with artificial greening soil 16 to prepare a ground for the culture of flora. In addition, when it is desired, a watering means may be provided over the water-permeable concrete.

To offer a site at which flora grow, the aerial H beams 13' is established at an angle of 60 to 75° to the earth surface, so that there can be brought about a reduction in the active earth pressure that is exerted on the concrete retaining wall. Accordingly, the lower plate (the base slab) of the retaining wall can be formed in a short length, so that the amount of the back side soil to be removed can be reduced. Additionally, the slant side prevents the occurrence of the overturning failure. Even if the concrete retaining wall of the present invention is lowered in water drainability, it. does not suffer the overturning failure caused by hydrostatic pressure thanks to the slant and water permeability thereof.

The water-permeable concrete useful in the present invention is prepared from a composition comprising, by weight, saline-free water 45–55 parts, smashed or course sand 200–250 parts, aluminum powder, acting as a foaming agent, 0.3–1 part, and optionally a high performance fluidizing agent 0.01–1 part, based on 100 parts of Portland cement. Any of the fluidizing agents commonly used in the art may be selected. Before being applied to the steel skeleton, the concrete composition is well mixed for 1–3 min. Compared to ordinary watertight concrete, the water-permeable concrete contains more pores and thus is superior in water absorption, permeation and distribution. Covering the water-permeable concrete, the artificial greening soil allows the growth of flora such as plants, grasses, lawn, flowers and the like, on the basis of the water supply function of the water-permeable concrete.

Useful in the present invention, the artificial greening soil comprises 30–50% by weight of organic leaf mold with a water content of 50–80%, 40–60% by weight of earth and sand with a water content of 5–15%, 1.0–5.0% by weight of a chopped, natural fibrous material with a length of 3–5 cm, selected from the group consisting of rice straw, barley straw, wheat straw, and mixtures thereof, 5–12% by weight of water, 0.001–0.1% by weight of sodium alginate, and 0.001–0.1% by weight of an acidity controller, as described in Korean Pat. Appl'n No. 2000-11993 applied by the present inventors, the content of which is incorporated as a reference into the present invention.

With reference to FIG. 3, there is shown a concrete retaining wall 10 in accordance with another embodiment of the present invention. As seen in this figure, the concrete retaining wall 10 of this embodiment of the present invention has a steel skeleton made of H beams 13 and 13', L beams 14, wire meshes 11, a concrete muscle 12, coated on the skeleton, having a stepped slant side, and a soil skin 16 covering the concrete 12. This embodiment has the same structure as that of FIG. 2, except that the aerial H beams 13 stand curved.

Turning now to FIG. 4, there is shown a concrete retaining wall structure suited for application to banks where a high active earth pressures are generated, in accordance with a further embodiment of the present invention.

When the bank is as high as or higher than 8 m, multiple layers of geotextile mats 17 are provided to the back side of the retaining wall to reduce the active earth pressure which is exerted directly on the retaining wall. Hence, the members of the retaining wall can be lightened or minimized. For instance, after the vertical arrangement interval of the mats is determined to be about 0.5 m, their size is determined in consideration of the tensile strength necessary to endure their weight. Preferably in views of economics and safety, the length of the mats is as large as or smaller than the height of the retaining wall. In order to prevent the occurrence of displacement at the edge of the mats and to maintain the mats tightened during the laying of multiple layers of mats, sandbags 18 are placed on both ends of each mat to fix it. In this regard, two sandbags 18 are used in each mat layer in such a way that one is surrounded with a terminal portion of the mat and the other is surrounded with the other terminal portion of the mat. The mat whose opposite terminal portions surround sandbags 18 is overlaid with another mat to form the multiple layers of mats, which function to reduce the active earth pressure which is exerted directly on the retaining wall.

With such a structure, the concrete retaining wall structure of the present invention can overcome the deformation occurring at the edge portion of the mats upon laying mats and making the multiple mat layers harden by stamping. Of course, the retaining wall structure of FIG. 4 allows the growth of flora on its front side by applying the artificial greening soil to the water-permeable concrete 12 covering the steel skeleton. Additionally, the improved support to the ground foundation 15 the ends of the mat prevents the deformation of mats at the edge portions, which has been problematic in conventional construction methods. The application of the mat reinforcement prevents sloped formations, even if having steep slopes, from collapsing during the stamping of the ground.

Furthermore, the green concrete retaining walls of the present invention can be applied to a slope of a cut or banked rock area. In this case, the water-permeable concrete is filled between the retaining wall and the rock to prevent the weathering of the rock.

The same drainage as in conventional concrete retaining walls can be designed for the back side of the green concrete retaining walls of the present invention. Hence, the green concrete retaining walls of the present invention can be constructed more thinly and quickly than conventional concrete retaining walls. In addition to being environment-friendly, the green concrete retaining walls of the present invention look fine externally. Furthermore, the green concrete retaining walls of the present invention are constructed to be curved to adapt to local geographic configurations, thereby harmonizing with the surroundings.

A better understanding of the present invention may be obtained in light of the following examples which are set forth to illustrate, but are not to be construed to limit the present invention.

EXAMPLE 1

Construction of Concrete Retaining Wall 6.0 m High

Dimensions of the steel members used for the construction of a concrete retaining wall 6.0 m high were as follows.

Used as main and secondary members, H beams had a height of 200 mm, a width of 200 mm, a core thickness of 10 mm, a thickness at the core of 10 mm, a thickness at the periphery of 16 mm, and a central curvature of 13 mm. L beams, used for preventing the lateral deformation of the retaining wall, were 90 mm in height, 90 mm in width, 13 mm in thickness, 10 mm in central curvature, and 7 mm in outer curvature. Main H beams with a length of 6.3 m were arranged at space intervals of 1.0 m at an angle of 73° to the earth surface on horizontal basal members. In this connection, H beams are bound to the basal members by bolting or soldering. Between the main H beams, supplementary H beams with a length of 3.5 m are established on the horizontal basal members at an angle of 73° to the basal members. The binding of the supplementary H beams to the basal members is accomplished by bolting or soldering. Used as the horizontal basal members were H beams 4.0 m long, on which the main and the supplementary H beams were established at the mid point. Thus, half of each basal member was present in the front side while the other half was in the back side.

Beneath the horizontal basal members, H beams were provided as slide-preventive members. At the mid point of the back side half of the basal members, the slide-preventive members were established. In this regard, the slide-preventive members were bound at a right angle to the horizontal basal members by bolting or soldering.

In addition, L beams were provided to both of the front and the back sides of the aerial main and supplementary members at space intervals of 1.5 m at a right angle to the main and supplementary members to prevent the lateral deformation of the aerial members. Bolting or soldering was performed to bind the L beams to the aerial members.

The basal horizontal members were also prevented from being deformed laterally by the reinforcement of L beams. Provided at space intervals of 0.6 m to both the upper and the lower sides of the horizontal basal members, the L beams were bound to the horizontal basal members by bolting or soldering. Steel members, each being a triangle with a front angle of 75° and with a dimension of 50 cm in height and 50 cm in a base side, were provided to the back side part and bolted and soldered such that the main members, the supplementary members, and the horizontal basal members were completely united.

After completion of the establishment of the steel members, they were coated with wire meshes (#4). To the horizontal basal members and the slide-preventive members, ordinary watertight concrete (25-240-(8-12)) was applied. 7 days after the application, cement paste was coated on the steel members by shortcrete, followed by applying water-permeable concrete onto the cement paste. The composition of the water-permeable concrete is given in Table 1, below.

TABLE 1

| Component | Amount | Characteristics |
|---|---|---|
| Cement | 400 kg | Portland Cement |
| Sand | 900 kg | Smashed or Coarse Sand (fineness modulus >2.4) |
| Foaming Agent | 2 kg | Al powder |
| Fluidizer | 1 kg | Powder Naphthalene type (Econex Co. Ltd) |
| Water | 200 kg | Saline-free |

The water-permeable concrete after the curing was found to show physical and mechanical properties as follows:

Specific gravity of water-permeable concrete ≈2.78

Weight per volume of dry core specimen ≈1.7–2.0 t/m$^3$

Internal porosity of core specimen ≈20–30%

Compression strength of core specimen ≈120–200 kg/cm$^2$

Falling head permeability test as being covered with rubber membrane $K \geqq 3\times10^{-3}\sim6\times10^{-4}$ cm/sec Because the permeability of the concrete was similar to that of ordinary solid earth and sand as shown above, moisture conditions for backfill earth and sand were determined as being good.

As for the concrete forms through which the water-permeable concrete was applied, they were constructed to have steps, each of which was 5 cm and 15 cm in the lengths of horizontal and vertical planes, respectively. 7 days after the application of the water-permeable concrete, the artificial greening soil spread over a PVC net (or Geogrid) was deposited over the water-permeable concrete. The composition of the artificial greening soil is given in Table 2, below.

TABLE 2

| Composition | Characteristic | Amount (Wt %) | Weight (kg/m$^1$) Dry Wt. | Water Content | Total |
|---|---|---|---|---|---|
| Leaf Mold | Peat moss etc. (water content ca. 70%) | 40% | 260.0 | 180.0 | 440.0 |
| Earth and Sand | Coarse sand and in situ earth mixture (1:1) (water content ca. 11~12%) | 50% | 493.0 | 57.0 | 550.0 |
| Natural Fibrous material | Rice, Barley and Wheat straw chopped at 3~5 cm | 1.0% | 11.0 | — | 11.0 |
| Water | Natural water (pH 6~7) | 9.0% | | 99.0 | 99.0 |
| Anti-corrosive | Sodium alginate | | 5.0 | | 5.0 |
| Fertilizer | Composite fertilizer | | 1.2 | | 1.2 |
| Acidity Controller | Superphosphate lime | | 1.0 | | 1.0 |

EXAMPLE 2

Construction of Green Concrete Retaining Wall 10 m High

A steel skeleton was constructed with the same beams as in Example 1, except that the lengths of the members were 10.5 m for the main beams, 7.0 m for the supplementary beams and 6.0 m for the horizontal basal beams (front side portion 2.0 m, back side portion 4.0 m). Like the steel skeleton of Example 1, the steel skeleton was provided with slide-preventive members at the horizontal basal members and with L beams to prevent the lateral deformation of the aerial and basal members.

After binding the members to each other, wire meshes (#4) were established as in Example 1, followed by the application of watertight concrete to the horizontal basal members and the slide-preventive members. The application of the watertight concrete was also conducted onto triangular steel members located at the back side portion around which the main, the supplementary, and the horizontal basal members were brought into contact with each other. 7 days after the application, cement paste was coated on the steel members by shortcrete, followed by applying water-permeable concrete onto the cement paste by a height of 3.0 m.

Concurrently with the stepwise application of water-permeable concrete, geotextile mats (PET Mats, tensile strength T=15–25 t/m) were layered at space intervals of 50 cm in such a way that sandbags were surrounded with both end portions of each mat and overlaid on another surrounded sandbag.

After the resulting retaining wall structure had settled safety, the artificial greening soil was coated over the front side to provide an area in which flora could grow well.

Lawn seeds were sowed in the artificial greening soil of the retaining walls of Examples 1 and 2 and the ground constructed at the back side (soil in situ) and watered while monitoring the germination of the seeds. After 15 days, the seeds sprouted in both the artificial greening soil and the ground. Lawn grew well over total seeding areas for one month. After two months, the lawn on the artificial greening soil was observed to outgrow that on the ground.

As described hereinbefore, the green concrete retaining walls of the present invention allow the growth of flora, such as plants, grasses, flowers and the like, therein, making contribution to the appearance of the street and giving peaceful sense to people. In addition to being constructed within a shorter period of time compared to conventional retaining walls, the green concrete retaining walls of the present invention are simple in making of drawings for arrangement of steel members in consideration of bending resistance and shearing resistance against active earth pressure and thus, there are scarcely present the problems resulting from the misreading of the drawings or miscalculation upon construction. Additionally, the quality control of the concrete used in the present invention is easy owing to its relative simplicity in composition. Because the steel members can be prepared on the site, they suffer no transportation problems. The light weight of the concrete does not cause the deformation of concrete forms. Even though joints are formed, they do not defile the appearance of the street because they are covered with the green skin. Further, the wire meshes have the advantage of preventing the concrete from cracking during the curing period and making it simple to mend structurally deformed portions. With the structure illustrated above, the green concrete retaining walls of the present invention can be constructed to a height larger than 9 m.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for constructing a concrete retaining wall structure, comprising the steps of:

establishing a steel skeleton comprising basal H beams, aerial H beams, L beams, structural steel tubes and steel plates, said basal H beams and said aerial beams being arranged in a direction parallel with the earth's surface and at a significant angle to the earth's surface, respectively, at such spaced intervals and dimensions that the retaining wall structure has sufficient bending resistance to overcome active earth pressures, said L beams, said structural steel tubes and said steel plates being provided as reinforcements between said arranged H beams;

applying watertight concrete to the H beams formed as bases of the steel skeleton in the horizontal direction to support the steel skeleton;

providing wire meshes onto the vertically directed H beams, the L beams, the structural tubes and steel plates;

coating the wire mesh-mounted structure with water-permeable concrete to form a stepped or embossed external surface; and covering the concrete with artificial greening soil, the artificial greening soil allowing the growth of flora therein.

2. The method as set forth in claim 1, wherein the basal H beams are individually bound to the aerial H beams such that each of the basal H beams is divided into a front side part and a back side part on the basis of the connection point between the basal and the aerial H beams, said front side part having a length one sixth to half of the height of the retaining wall, said back side part having a length one fourth to half of the height of the retaining wall.

3. The method as set forth in claim 1, wherein the aerial H beams are established at an angle of 60–75° to the earth surface.

4. The method as set forth in claim 1, wherein the water-permeable concrete comprises saline-free water 45–55 parts by weight, smashed or course sand 200–250 parts by weight, aluminum powder, acting as a foaming agent, 0.3–1 part by weight, and optionally a high performance fluidizing agent 0.01–1 part by weight, based on 100 parts of ordinary Portland cement.

5. The method as set forth in claim 1, wherein the artificial greening soil comprises 30–50% by weight of organic leaf mold with a water content of 50–80%, 40–60% by weight of earth and sand with a water content of 5–15%, 1.0–5.0% by weight of a chopped, natural fibrous material with a length of 3–5 cm, selected from the group consisting of rice straw, barley straw, wheat straw, and mixtures thereof, 5–12% by weight of water, 0.001–0.1% by weight of sodium alginate, and 0.001–0.1% by weight of an acidity controller.

6. The method as set forth in claim 1, further comprising the step of applying the retaining wall to a slope of a cut or banked rock area and filling the water-permeable concrete between the retaining wall and the rock area.

7. The method as set forth in claim 1, wherein the retaining wall is reinforced with multiple layers of geotextile mats at a back sides of the retaining wall to reduce the back side active earth pressure when the banked area of the retaining wall is as high as or higher than 8 m, whereby the retaining wall's structure is lightened and minimized.

8. The method as set forth in claim 7, wherein each of the mats is provided with two sandbags at opposite ends such that one sandbag is surrounded with a terminal portion of the mat and another sandbag is surrounded with the other terminal portion, and the mats are overlaid one by one to form multiple layers of mats, whereby the mats are prevented from being displaced at the ends and kept tight during the laying of multiple layers of mats.

9. A concrete retaining wall constructed according to the method of claim 1.

10. A concrete retaining wall constructed according to the method of claim 2.

11. A concrete retaining wall constructed according to the method of claim 3.

12. A concrete retaining wall constructed according to the method of claim 4.

13. A concrete retaining wall constructed according to the method of claim 5.

14. A concrete retaining wall constructed according to the method of claim 6.

15. A concrete retaining wall constructed according to the method of claim 7.

16. A concrete retaining wall constructed according to the method of claim 8.

* * * * *